US007480482B2

(12) United States Patent
Sheng

(10) Patent No.: US 7,480,482 B2
(45) Date of Patent: Jan. 20, 2009

(54) PRINTING DEVICE CAPABLE OF INCREASING A PRINTING SPEED

(75) Inventor: Thomas Sheng, Hsinchu (TW)

(73) Assignee: Avisian Inc. (TW)

( * ) Notice: Subject to any disclaimer, the term of this patent is extended or adjusted under 35 U.S.C. 154(b) by 464 days.

(21) Appl. No.: 11/261,500

(22) Filed: Oct. 31, 2005

(65) Prior Publication Data

US 2006/0180974 A1 Aug. 17, 2006

(30) Foreign Application Priority Data

Nov. 3, 2004 (TW) ..... 93133475 A

(51) Int. Cl.
*G03G 15/00* (2006.01)

(52) U.S. Cl. ..... 399/389; 399/391; 358/1.18

(58) Field of Classification Search ..... 399/389, 399/391, 45; 358/1.12, 1.16, 1.18, 296, 300; 271/9.01, 9.05
See application file for complete search history.

(56) References Cited

U.S. PATENT DOCUMENTS 4,876,562 A * 10/1989 Suzuki et al. ..... 347/139
5,220,431 A * 6/1993 Yamagguchi ..... 358/296
5,239,388 A * 8/1993 Matsumoto ..... 358/448
5,323,212 A 6/1994 Fukui
5,600,429 A * 2/1997 Kutsuwada ..... 399/17
5,828,818 A * 10/1998 Anzai ..... 358/1.18
6,005,672 A * 12/1999 Yoshida ..... 358/434
6,266,512 B1 * 7/2001 de Koning et al. ..... 399/370
6,546,215 B2 * 4/2003 Machida ..... 399/82

FOREIGN PATENT DOCUMENTS

JP 2000200014 A * 7/2000
JP 2003305914 A * 10/2003

* cited by examiner

*Primary Examiner*—Robert Beatty

(57) ABSTRACT

In a printing device capable of increasing a printing speed, a sheet-feeding mechanism selectively feeds to-be-printed sheets placed in a longitudinal tray and a transversal tray. A memory stores a transversal maximum printing dimension corresponding to a printing unit. A processor receives a printing signal containing first and second dimensions. The processor judges whether or not a maximum of the first dimension and the second dimension is smaller than or equal to the transversal maximum printing dimension. If yes, the processor enables the sheet-feeding mechanism to feed the to-be-printed sheet placed in the transversal tray. The processor further judges whether or not the first dimension is smaller than the second dimension. If yes, the processor rotates a printing content corresponding to the printing signal by 90 degrees and then outputs a rotated content to the printing unit. If not, the processor directly outputs the printing signal to the printing unit.

4 Claims, 4 Drawing Sheets

PRINTING DEVICE CAPABLE OF INCREASING A PRINTING SPEED

BACKGROUND OF THE INVENTION

1. Field of the Invention

The invention relates to a printing device capable of increasing a printing speed, and more particularly to a printing device capable of automatically selecting a suitable sheet among a plurality of sheets placed in trays and quickly printing data on the sheet in a paper-jam-free manner.

2. Description of the Related Art

A conventional digital copier often includes multiple trays in response to different output demands. The dimension of the original may be detected, and the to-be-printed sheet satisfying the dimension of the original may be selected according to the detected result. Alternatively, the to-be-printed sheet and the scaling ratio may be selected manually such that the data can be printed on the to-be-printed sheet.

Although the digital copier has the function of enabling the user to select the desired sheet in the suitable tray or of automatically selecting a suitable sheet in the suitable tray, as disclosed in U.S. Pat. No. 5,323,212, the sheet-feeding mode corresponding to the maximum dimension of the printable sheet is the mode in which the sheet is fed longitudinally, such that the width of the copier may be minimized. For example, the typical copier usually has an A4-sized tray, in which A4-sized sheets may be placed, and an A3-sized tray, in which A3-sized sheets may be placed. The A4-sized tray may accommodate the longitudinal A4-sized sheets, each of which is longitudinally fed in a travelling direction extending in a lengthwise direction of the sheet. The A3-sized tray may accommodate the A3-sized sheets or the A4-sized sheets arranged transversally. The A4-sized sheets arranged transversally in the A3-sized tray are fed in a travelling direction extending in a widthwise direction of the sheet. When the longitudinal A4-sized sheet is being printed, the printing speed is low and the condition of paper jam tends to occur at the curved sheet passageway because the sheet stays in the sheet passageway for a longer period of time. When the sheet is thick or when the sheet is a slider, the condition of paper jam tends to occur more easily. Thus, the printing device cannot be used conveniently.

SUMMARY OF THE INVENTION

It is therefore an object of the invention to provide a printing device capable of increasing a printing speed, wherein the printing device is capable of automatically selecting a suitable sheet among a plurality of sheets placed in trays and quickly printing data on the sheet in a paper-jam-free manner.

To achieve the above-identified object, the invention provides a printing device capable of increasing a printing speed. The printing device includes a longitudinal tray, a transversal tray, a sheet-feeding mechanism, a printing unit, a memory and a processor. A first sheet may be placed in the longitudinal tray. The first sheet has a length and a width smaller than the length of the first sheet. A travelling direction of the first sheet in the longitudinal tray extends along a lengthwise direction of the first sheet. A second sheet may be placed in the transversal tray. The second sheet has a length and a width smaller than the length of the second sheet. A travelling direction of the second sheet in the transversal tray extends along a widthwise direction of the second sheet. The sheet-feeding mechanism selectively feeds the first sheet and the second sheet respectively placed in the longitudinal tray and the transversal tray. The printing unit prints data on the first sheet and the second sheet. The memory stores a transversal maximum printing dimension corresponding to the printing unit. The processor receives an image signal containing a first dimension and a second dimension.

The processor judges whether or not a maximum of the first dimension and the second dimension is smaller than or equal to the transversal maximum printing dimension, and enables the sheet-feeding mechanism to feed the second sheet placed in the transversal tray and processes the image signal into a printing signal if yes. The processor further judges whether or not the first dimension is smaller than the second dimension, and rotates a printing content corresponding to the printing signal by 90 degrees to generate a rotated content and outputs the rotated content to the printing unit if yes, or otherwise directly outputs the printing signal to the printing unit.

According to the printing device of the invention, the time for printing data on a sheet may be effectively shortened, and the paper jam may be effectively avoided.

DETAILED DESCRIPTION OF THE INVENTION

Figure 1:
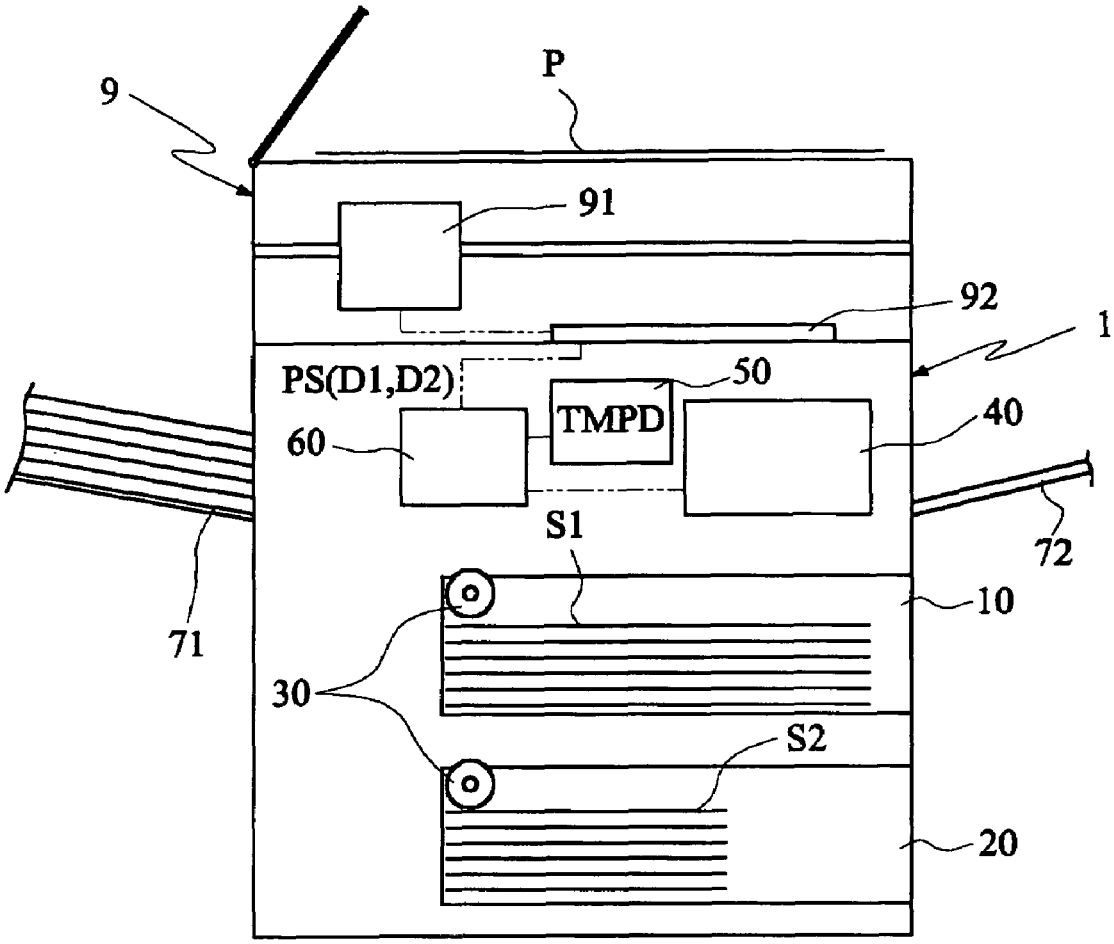
FIG. 1 is a schematic illustration showing a digital copier equipped with a printing device according to a preferred embodiment of the invention.
Figure 1:
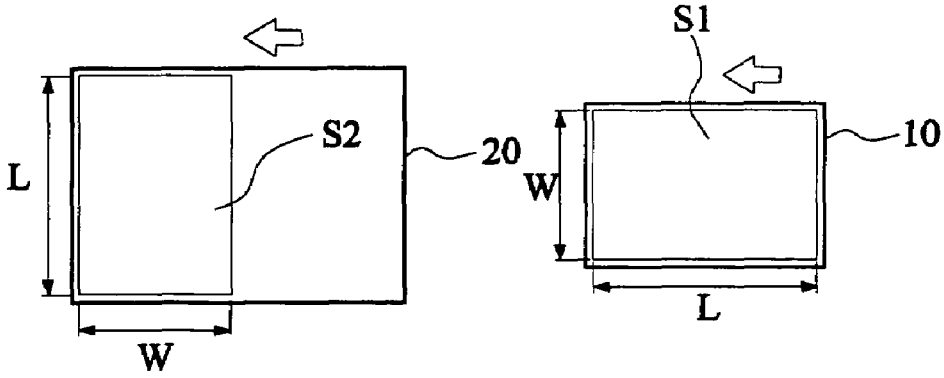

FIG. 1 is a schematic illustration showing a digital copier equipped with a printing device according to a preferred embodiment of the invention. As shown in FIG. 1, the digital copier, which may also be a multi-function peripheral, according to the invention is composed of a printing device 1 and a scanning device 9. The scanning device 9 includes a scanning module 91 and a processing circuit 92. The scanning module 91 scans a document P placed on the scanning device 9 to obtain an image signal and transmits the image signal to the processing circuit 92. The processing circuit 92 outputs a printing signal PS, which contains a first dimension D1 and a second dimension D2 defining a rectangular area.

The printing device 1, which is capable of increasing the speed for printing data on a sheet having a width smaller than that of a maximum printing sheet, includes a longitudinal tray 10, a transversal tray 20, a sheet-feeding mechanism 30, a printing unit 40, a memory 50, a processor 60, a manual tray 71 and a sheet output tray 72. The manual tray 71 and the sheet output tray 72 have the same functions as the typical copier, and detailed descriptions thereof will be omitted.

A first sheet S1 having a length L and a width W shorter than the length L may be placed in the longitudinal tray 10. A travelling direction of the first sheet S1 in the longitudinal tray 10 extends along a lengthwise direction. A second sheet S2 having a length L and a width W shorter than the length L may be placed in the transversal tray 20. That is, the second sheet S2 is the same as the first sheet S1 after being rotated by 90 degrees. A travelling direction of the second sheet S2 in the transversal tray 20 extends along a widthwise direction. The sheet-feeding mechanism 30 selectively feeds the first and second sheets S1 and S2 respectively placed in the longitudinal tray 10 and the transversal tray 20. The printing unit 40 prints data on the first or second sheet S1 or S2. The memory 50 stores a transversal maximum printing dimension TMPD corresponding to the printing unit 40. The processor 60 receives the printing signal PS containing the first dimension D1 and the second dimension D2.

Figure 4:
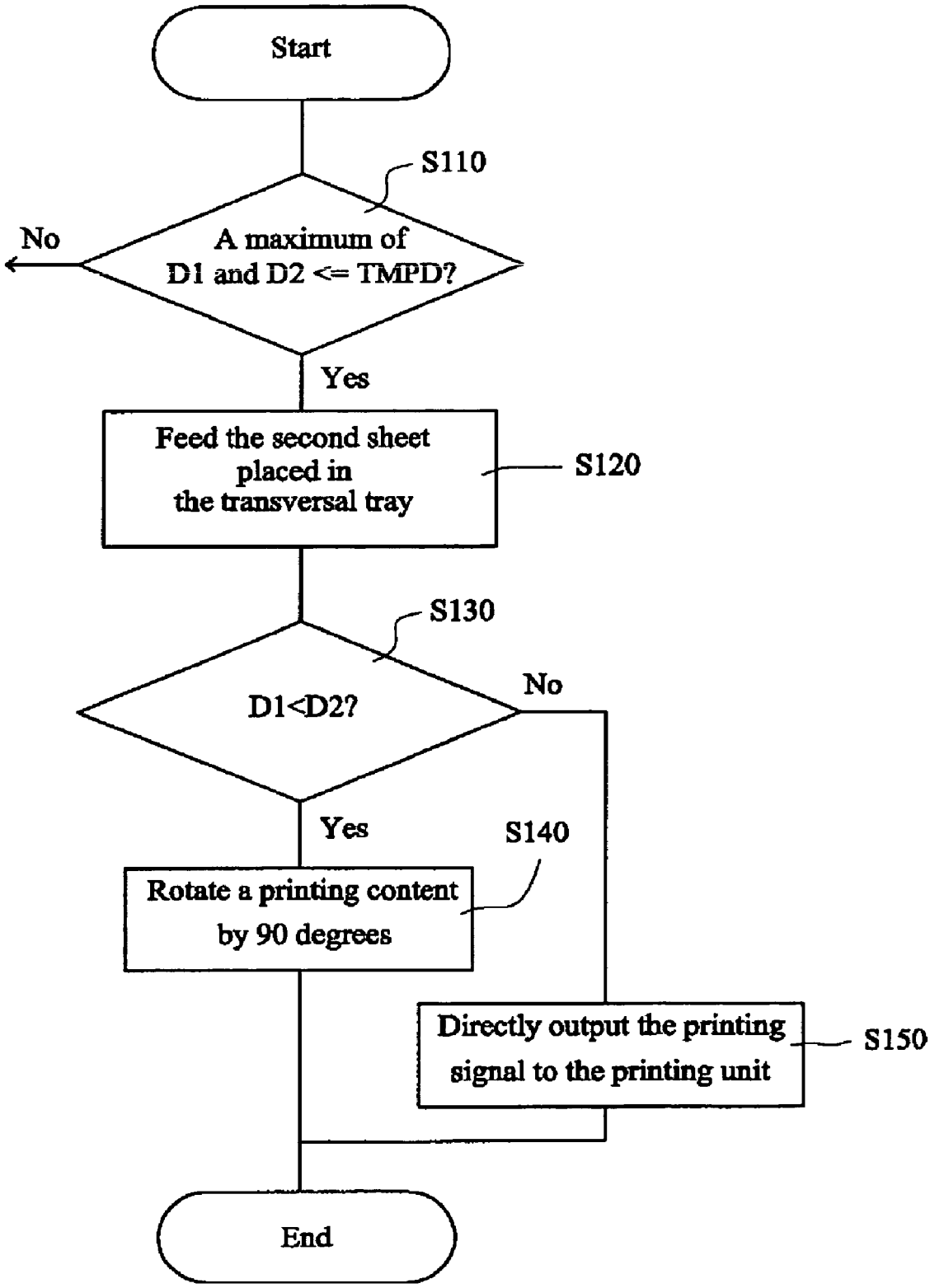
FIG. 4 is a flow chart showing a method performed by a performed by a processor of the printing device.

The processor 60 judges whether or not a maximum of the first dimension D1 and the second dimension D2 is smaller than or equal to the transversal maximum printing dimension TMPD, as shown in step S110 of FIG 4. If yes, the processor 60 enables the sheet-feeding mechanism 30 to feed the second sheet S2 placed in the transversal tray 20, as shown in step S120 of FIG 4. The processor 60 further judges whether or not the first dimension D1 is smaller than the second dimension D2, as shown in step S130 of FIG 4. If yes, the processor 60 rotates a printing content corresponding to the printing signal PS by 90 degrees to generate a rotated content and then outputs the rotated content to the printing unit 40, as shown in step S140 of FIG 4. If not, the processor 60 directly outputs the printing signal PS to the printing unit 40, as shown in step S150 of FIG 4.

Figure 2:
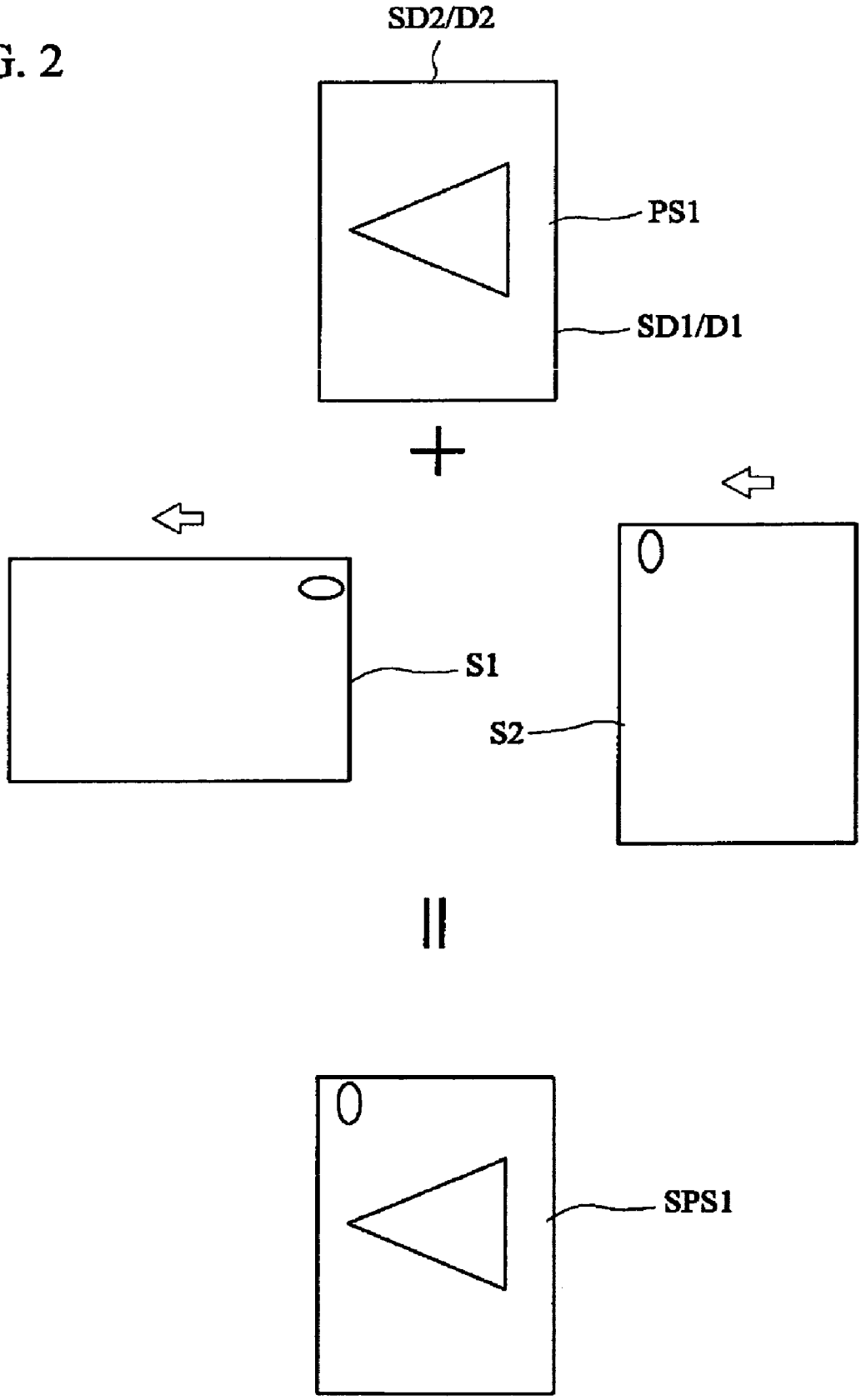
FIG. 2 is a schematic illustration showing a first example of the digital copier of the invention in a copying procedure.
Figure 3:
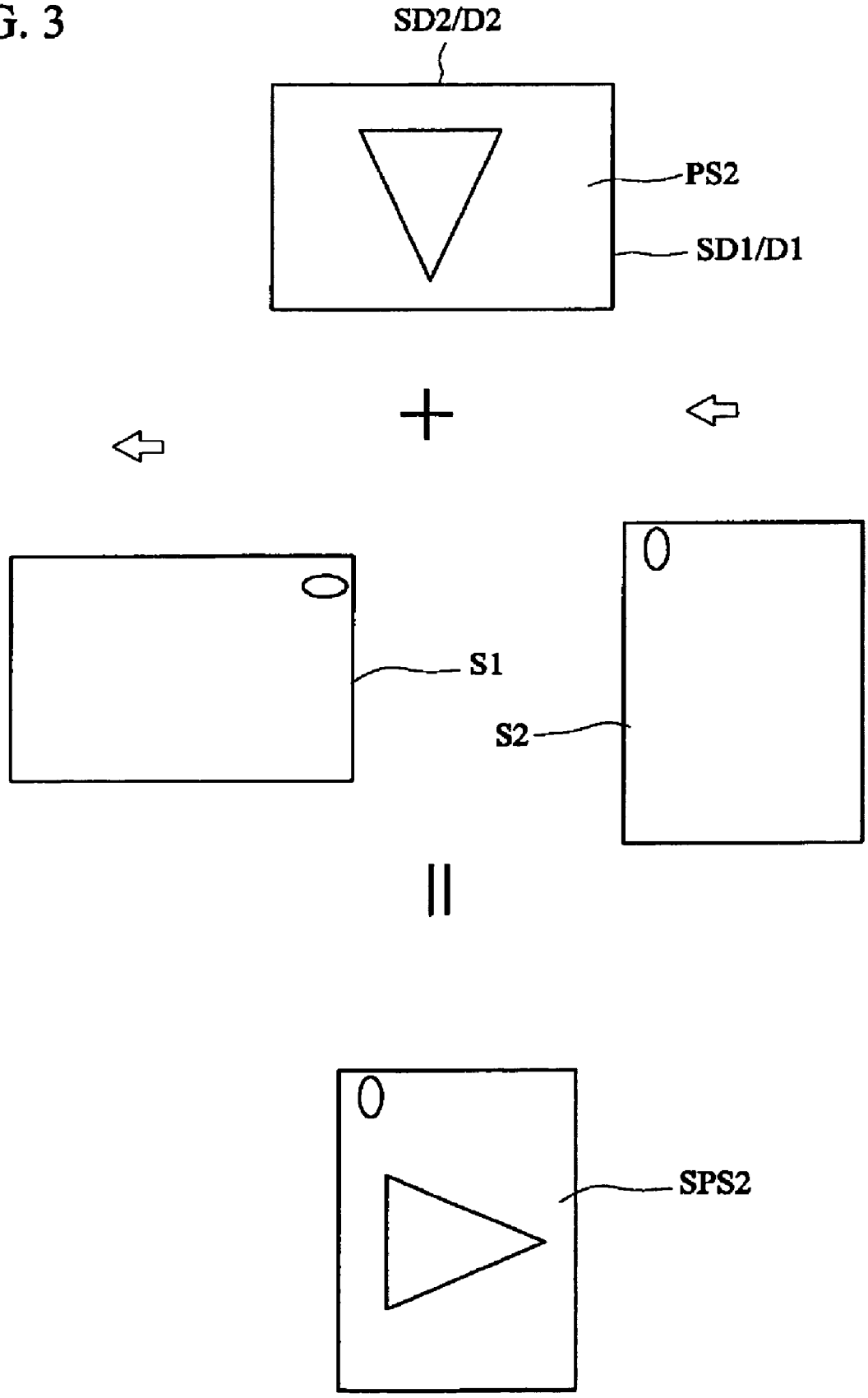
FIG. 3 is a schematic illustration showing a second example of the digital copier of the invention in a copying procedure.

In another embodiment, the processing circuit 92 outputs an image signal containing a first dimension D1 and a second dimension D2 defining a rectangular area having a first side SD1 with the first dimension D1 and a second side SD2 with the second dimension D2. as shown in FIGS. 2 and 3. The processor 60 receives the image signal containing the first dimension D1 and the second dimension D2, and processes the image signal into a printing signal. The first side SD1 of the rectangular area extends in a direction parallel top direction, along which the sheet-feeding mechanism 30 feeds the first sheet S1 and the second sheet S2, as indicated by the arrows. The processor 60 further judges whether or not the first dimension D1 is smaller than the second dimension D2. If yes, the processor 60 rotates the printing content corresponding to the printing signal by 90 degrees to generate the rotated content and then outputs the rotated content to the printing unit 40. If not, the processor 60 directly outputs the printing signal to the printing unit 40.

FIG. 2 is a schematic illustration showing a first example of the digital copier of the invention in a copying procedure. For example, when a printing signal PS1 corresponds to the dimension of a longitudinal A4-sized sheet, the processor judges whether or not the maximum of the first dimension (297 mm) and the second dimension (210 mm) is smaller than or equal to the transversal maximum printing dimension (297 mm). If yes, the processor enables the sheet-feeding mechanism to feed the second sheet S2 placed in the transversal tray. The processor further judges whether or not the first dimension (297 mm) is smaller than the second dimension D2 (210 mm), rotates the printing content corresponding to the printing signal PS1 by 90 degrees to generate the rotated content and outputs the rotated content to the printing unit if yes, or otherwise directly outputs the printing signal to the printing unit. Because the judged result is "NO", the printing signal PS1 is outputted to the printing unit. Thus, the A4-sized sheet S2 placed in the transversal tray is selected as the printing medium. In this case, the sheet is fed transversally as indicated by the arrow, and a printed document SPS1 is produced.

FIG. 3 is a schematic illustration showing a second example of the digital copier of the invention in a copying procedure. For example, when a printing signal PS2 corresponds to the dimension of a transversal A4-sized sheet, the processor judges whether or not the maximum of the first dimension (210 mm) and the second dimension (297 mm) is smaller than or equal to the transversal maximum printing dimension (297 mm). If yes, the processor enables the sheet-feeding mechanism to feed the second sheet S2 placed in the transversal tray. The processor further judges whether or not the first dimension (210 mm) is smaller than the second dimension D2 (297 mm), rotates the printing content corresponding to the printing signal PS2 by 90 degrees to generate the rotated content and outputs the rotated content to the printing unit if yes, or otherwise directly outputs the printing signal to the printing unit. Because the judged result is "YES", the printing content corresponding to the printing signal PS2 is rotated by 90 degrees to generate a rotated result, and the rotated result is outputted to the printing unit. Thus, the A4-sized sheet S2 placed in the transversal tray is selected as the printing medium. In this case, the sheet is fed transversally as indicated by the arrow, and a printed document SPS2 is produced.

According to the printing device of the invention, the time for printing data on a sheet may be effectively shortened, which is advantageous to the condition of mass printing, and the condition of paper jam may be effectively avoided. In addition, the printing mode provided by the invention may be added to the conventional printing device or the digital printing apparatus to provide the users for another choice of shortening the printing time and avoiding the paper jam.

While the invention has been described by way of examples and in terms of preferred embodiments, it is to be understood that the invention is not limited to the disclosed embodiments. To the contrary, it is intended to cover various modifications. Therefore, the scope of the appended claims should be accorded the broadest interpretation so as to encompass all such modifications.

What is claimed is:

1. A printing device, comprising:

a longitudinal tray, in which a first sheet may be placed, the first sheet having a length and a width smaller than the length of the first sheet, wherein a travelling direction of the first sheet in the longitudinal tray extends along a lengthwise direction of the first sheet;

a transversal tray, in which a second sheet may be placed, the second sheet having a length and a width smaller than the length of the second sheet, wherein a travelling direction of the second sheet in the transversal tray extends along a widthwise direction of the second sheet;

a sheet-feeding mechanism for selectively feeding the first sheet and the second sheet respectively placed in the longitudinal tray and the transversal tray;

a printing unit for printing data on the first sheet and the second sheet;

a memory for storing a transversal maximum printing dimension corresponding to the printing unit; and a processor for receiving a printing signal containing a first dimension and a second dimension, which define a rectangular area having a first side with the first dimension and a second side with the second dimension, wherein:

the first side of the rectangular area extends in a direction perpendicular to a direction, along which the sheet-feeding mechanism feeds the first sheet and the second sheet;

the processor judges whether or not a maximum of the first dimension and the second dimension is smaller than or equal to the transversal maximum printing dimension, and enables the sheet-feeding mechanism to feed the second sheet placed in the transversal tray if the maximum of the first dimension and the second dimension is smaller than or equal to the transversal maximum printing dimension; and the processor further judges whether or not the first dimension is smaller than the second dimension, and rotates a printing content corresponding to the printing signal by 90 degrees to generate a rotated content and outputs the rotated content to the printing unit if the first dimension is smaller than the second dimension, or otherwise directly outputs the printing signal to the printing unit.

2. The printing device according to claim 1 being used in a copier or a multi-function Peripheral.

3. A printing device, comprising:

a longitudinal tray, in which a first sheet may be placed, the first sheet having a length and a width smaller than the length of the first sheet, wherein a travelling direction of the first sheet in the longitudinal tray extends along a lengthwise direction of the first sheet;

a transversal tray, in which a second sheet may be placed, the second sheet having a length and a width smaller than the length of the second sheet, wherein a travelling direction of the second sheet in the transversal tray extends along a widthwise direction of the second sheet;

a sheet-feeding mechanism for selectively feeding the first sheet and the second sheet respectively placed in the longitudinal tray and the transversal tray;

a printing unit for printing data on the first sheet and the second sheet;

a memory for storing a transversal maximum printing dimension corresponding to the printing unit; and a processor for receiving an image signal containing a first dimension and a second dimension, which define a rectangular area having a first side with the first dimension and a second side with the second dimension, wherein:

the first side of the rectangular area extends in a direction perpendicular to a direction, along which the sheet-feeding mechanism feeds the first sheet and the second sheet;

the processor judges whether or not a maximum of the first dimension and the second dimension is smaller than or equal to the transversal maximum printing dimension, and enables the sheet-feeding mechanism to feed the second sheet placed in the transversal tray and processes the image signal into a printing signal if the maximum of the first dimension and the second dimension is smaller than or equal to the transversal maximum printing dimension; and the processor further judges whether or not the first dimension is smaller than the second dimension, and rotates a printing content corresponding to the printing signal by 90 degrees to generate a rotated content and outputs the rotated content to the printing unit if the first dimension is smaller than the second dimension, or otherwise directly outputs the printing signal to the printing unit.

4. The printing device according to claim 3 being used in a copier or a multi-function peripheral.

* * * * *